United States Patent [19]

Deike

[11] Patent Number: 4,615,156

[45] Date of Patent: Oct. 7, 1986

[54] POST ANCHOR

[75] Inventor: Robert F. Deike, Cheyenne, Wyo.

[73] Assignee: Construction Robotics, Inc., Chicago, Ill.

[21] Appl. No.: 693,373

[22] Filed: Jan. 22, 1985

[51] Int. Cl.[4] ..... E04B 1/00

[52] U.S. Cl. ..... 52/98; 52/40; 52/153; 52/165; 52/170; 404/11

[58] Field of Search ..... 52/40, 153–160, 52/165, 166, 98, 296, 298, 170; 404/11, 9; 40/606, 607, 612; 116/63 R

[56] References Cited

U.S. PATENT DOCUMENTS

| | | | |
|---|---|---|---|
| 397,039 | 1/1889 | Terrell et al. | 52/153 |
| 2,189,542 | 2/1940 | Caldwell et al. | 52/153 |
| 3,529,798 | 9/1970 | Williams et al. | 40/607 X |
| 3,606,222 | 9/1971 | Howard | 52/153 X |
| 4,021,977 | 5/1977 | Deike | 52/98 |
| 4,320,608 | 3/1982 | Deike | 52/165 |

OTHER PUBLICATIONS

Robert F. Deike U.S. Ser. No. 648,039.

*Primary Examiner*—Carl D. Friedman
*Assistant Examiner*—Naoko N. Slack
*Attorney, Agent, or Firm*—Hill, Van Santen, Steadman & Simpson

[57] ABSTRACT

A ground anchor for channel posts has an angle iron leg driven into the ground and an upright fin plate or strip secured to the upper end thereof to stabilize the leg against tilting. The channel post straddles the angle iron leg receiving the apex of the leg in the channel thereof and is deformed to spread its legs apart into tight gripping relation with the angle iron. The spreading apart of the legs may be effected by drawbolts which fixedly connect the channel post with the angle iron leg or by a tool applied to the post adjacent the leg permitting the post to enter a socket on the leg formed by the fin plate or strip whereupon releasing of the tool permits the spread apart post legs to spring back toward their free state position thereby bottoming the base of the post in the socket. The spread apart legs of the post tightly grip the angle iron leg. The post may be removed from the angle by releasing the drawbolts or by again applying a spreading tool to free the post from the socket.

12 Claims, 9 Drawing Figures

POST ANCHOR

BACKGROUND OF THE INVENTION

1. Field of the Invention

This invention relates to anchors for securing channel type sign posts and the like in the ground and in particular relates to channel post anchors having an angle iron leg driven into the ground and means on the upper end of the leg to lock the post to the leg in spread deformed position maintaining a fixed lock between the anchor and the post.

2. Description of the Prior Art

Heretofore, as in my prior U.S. Pat. Nos. 4,021,977 granted May 10, 1977 and 4,320,608 granted Mar. 23, 1982, sign posts were locked in the sockets of ground anchors by wedges which either deformed the post or were deformed. These wedges were buried in the ground with the post anchor and soon became so corroded that they could not be removed to permit removal of the posts.

It would be an improvement in this art to eliminate wedges in post anchors without, however, eliminating stressing of the post into locked relation with its anchor.

SUMMARY OF THE INVENTION

According to this invention, a leg, formed of conventional angle iron of a length sufficient to be driven into the ground to a depth capable of firmly anchoring a sign post has structure on its upper half holding the anchor in upright position and securing the side legs of a conventional channel post in stressed spread apart condition on the angle iron leg preventing shifting of the post relative to the leg.

The angle iron leg preferably has a pointed leading end, right angle side walls about two to three inches wide, and a length of about one to three feet. The structure holding the leg in upright position is an upright fin plate welded to the divergent ends of the side walls of the leg and having a height of five to ten inches and a width extending laterally beyond each side of the leg about two to six inches.

The channel sign post is of the conventional "hat section" type straddling the exterior sides of the angle iron leg along all or only a part of the length of the leg, preferably at least extending beyond the fin plate and, in some instances, it may even extend beyond the pointed leading end of the leg to provide the desired height for the sign secured on the upper end of the post. The side legs of the "hat section" channel post are bottomed on the sides of the angle iron leg with the apex of the leg projecting into the channel of the post. These legs are spread apart to ride toward the divergent ends of the angle iron walls and are held in stressed spread apart condition tightly against the angle iron by stressing means taking the form of drawbolts or a spreading tool.

The drawbolts extend through holes provided in the web or the base of the channel post and in the apex of the angle iron leg and are threaded into nuts or a threaded strip seated in the angle iron.

In the spreading tool embodiment, the fin plate has a strap portion embracing the upper end of the angle iron leg providing a socket to receive the post. The tool spreads the post legs and the post decreases in depth to straddle the sides or legs of the angle iron leg and slide into the socket whereupon releasing of the tool permits the post legs to spring back clamping the post between the strap and angle iron.

Wedges of the type required by the structures of my aforesaid patents are eliminated.

The "hat section" or channel post is easily removed from the anchor without removing the anchor from the ground by either releasing the bolts or by again applying a spreading tool.

The fin plate in the bolt stressed embodiment may be flat, spanning the divergent ends of the angle iron and welded thereto or in the tool stressed embodiment may embrace the apex of the angle iron providing therewith a socket receiving the post.

The spreading tool embodiment uses a tool clamped to the post at a level just above the post portion to be inserted through the socket and having a head forced into the channel of the post to spread the legs apart. In this embodiment, the gap between the angle iron leg and the portion of the fin plate bottoming the post is less than the free standing depth of the post straddling the angle iron but greater than the tool stressed depth of the post so that the end of the post, when spread by the tool, will fit into the socket between the angle iron leg and the fin plate and when the tool is released from the post it will tend to reclaim its free state depth but before doing so it will be bottomed on the fin plate. The post is thereby fixedly held on the angle iron leg in tight clamping relation therewith without requiring a wedge. In the event it is desired to remove the post from the socket, the spreading tool can be reapplied or if the post has been impacted and severed leaving only a stub in the socket, this remaining portion can be released by driving a spreading chisel into the channel of the stub, forcing the post legs apart and again decreasing the depth of the post. Such a tool can also be used to insert the post.

It is therefore an object of this invention to provide ground anchors for channel type sign posts which do not require wedges between the post and anchor.

Another object of this invention is to provide a ground anchor for conventional channel sign posts which holds the legs of the channel in spread apart tight frictional engagement therewith without the use of a wedge.

Another object of the invention is to provide an angle iron leg ground anchor for hat section sign posts free from members that have to be pried loose before the posts can be removed from the anchor.

A specific object of this invention is to provide a ground anchor for posts which has an angle iron leg driven in the ground, a fin plate on the top end thereof to stabilize the leg in the ground and drawbolts extending through the post spreading the legs thereof apart on the sides of the angle iron to clamp the post to the angle iron.

Another specific object of the invention is to provide a ground anchor for sign posts of the channel type which has an angle iron leg driven in the ground and a fin plate on the top end thereof embracing the apex of the angle iron providing a socket receiving outwardly stressed side legs of the post in clamped engagement with the sides of the angle iron.

Other and further objects of this invention will become apparent to those skilled in this art from the following detailed description of the annexed sheets of drawings which, by way of best mode embodiments illustrate two examples of this invention.

IN THE DRAWINGS

DETAILED DESCRIPTION OF THE DRAWINGS

Figure 1:
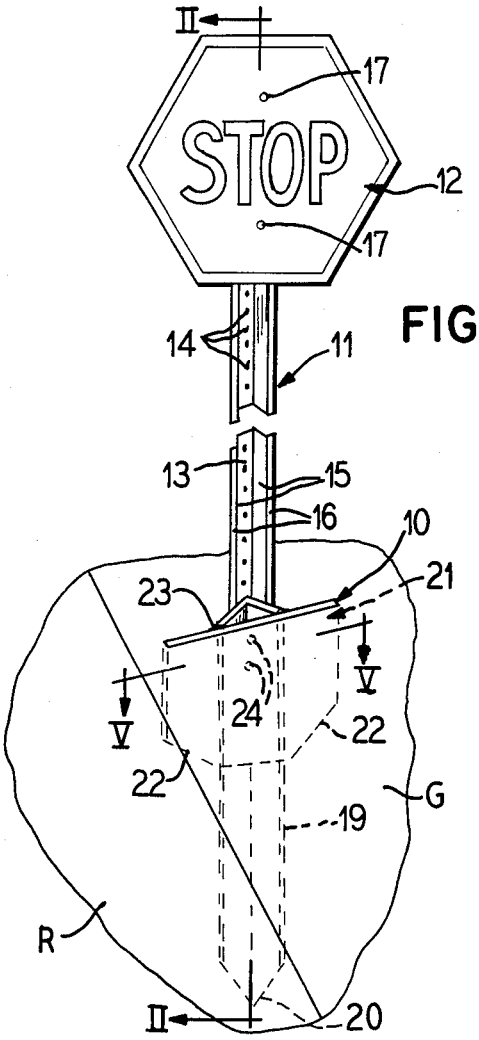
FIG. 1 is a broken perspective view of a channel strip sign post anchored in the ground along a roadway by a post anchor of this invention.
Figure 2:
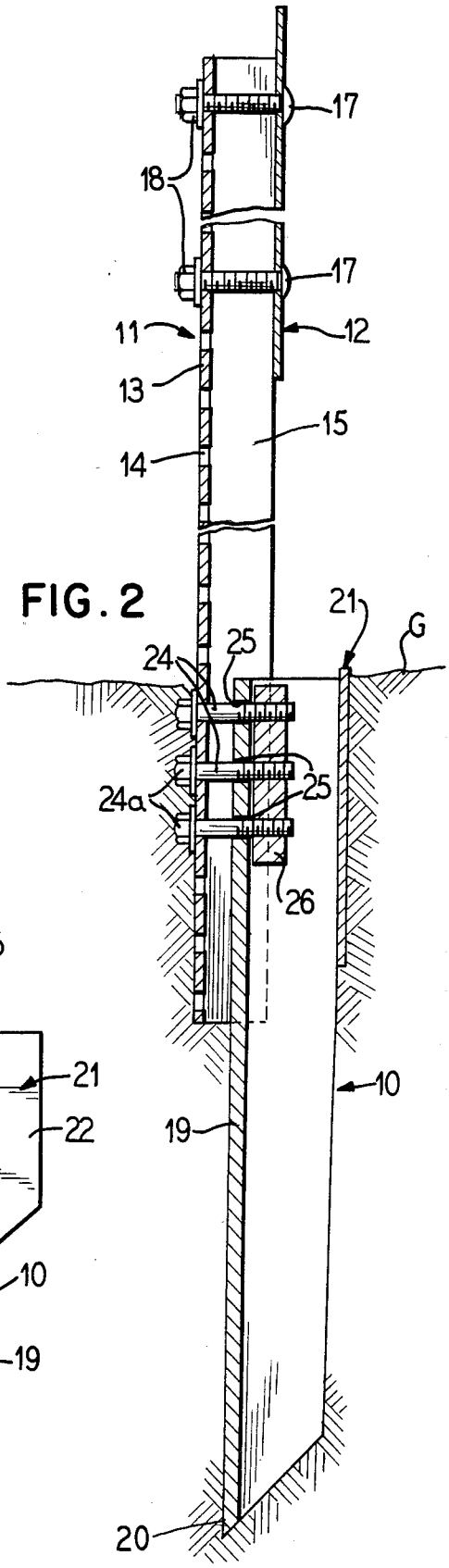
FIG. 2 is an enlarged fragmentary longitudinal sectional view along the line II—II of FIG. 1.
Figure 3:
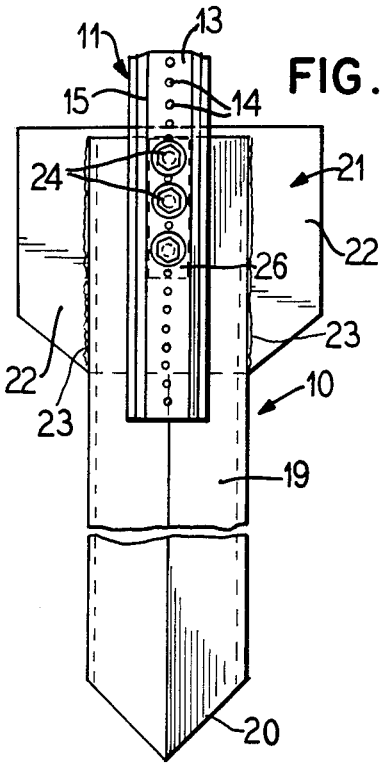
FIG. 3 is a broken back elevational view of the ground anchor and sign post of FIGS. 1 and 2.
Figure 4:
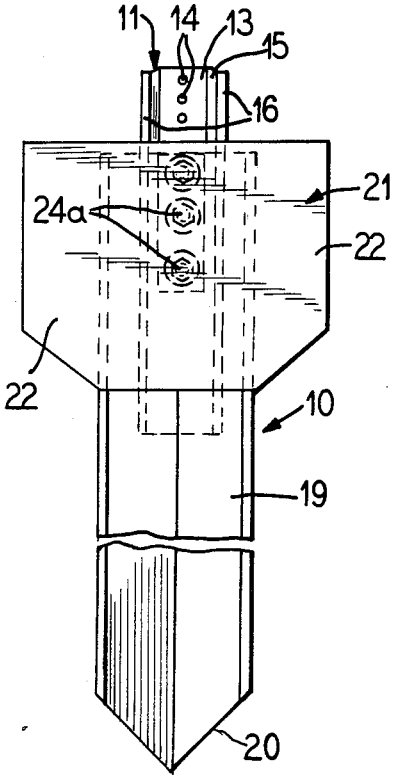
FIG. 4 is a broken front elevational view of the ground anchor and sign post of FIGS. 1–3.

As shown in FIG. 1, a ground anchor 10 of this invention is driven into the ground G along side a road R, supporting, in upright position, a conventional "hat section" or channel post 11 for a stop sign 12. This post 11 is a standard channel strip post used for highway signs having a so-called "hat" cross-section including a web or crown 13 with perforations 14 at spaced intervals of about 1 inch along the length thereof and with side legs 15 extending from the web to outturned flanges or fins 16. The sign 12 is bottomed on these flanges 16 and bolts 17 with heads bottomed on the sign extend through the sign and through the post perforations 14 to receive nuts 18, as better shown in FIG. 2, securing the sign to the post. The bolts of course could be replaced with rivets or other fasteners to lock the sign 12 tightly against the flanges or fins 16 of the channel post 11.

The anchor 10 is composed of a standard right angle iron leg 19 with a pointed end 20 and a metal fin plate or strip 21 welded to the top or trailing end of the leg 19. The plate 21 spans the open side of the angle iron leg 19 projecting laterally beyond the leg providing projecting fins 22. The plate 21 is welded at 23 to the divergent ends of the sides of the angle iron leg 19. The plate will have a height and a width commensurate with the size of the angle iron leg 19 so as to provide appreciable stabilizing fin surfaces maintaining the leg in upright position in the ground G. The fins 22 may have a width of about two to six inches and the fin plate may have a height of about five to ten inches but these dimensions can vary widely being generally increased when the anchors are driven into loose type soil such as sand and, of course, the length of the angle iron leg can vary widely depending upon the type of earth into which it is driven. The top of the fin plate and angle iron leg are generally driven into the ground to be flush or even slightly below the ground surface. In the embodiment of FIGS. 1–5, the fin plate 21 is flat and welded at 23 to the divergent ends of the sides of the angle iron leg 19.

Figure 5:
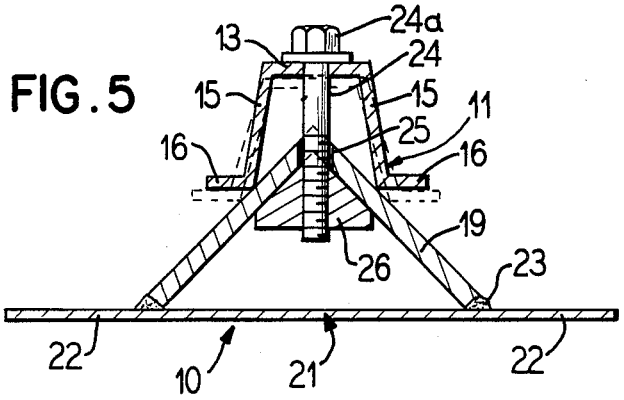
FIG. 5 is a transverse cross-sectional view along the line V—V of FIG. 1.

After the anchor 10 has been driven into the ground, the bottom end of the sign post 11 straddles the leg 19 receiving the apex of the leg in the channel thereof and is pushed along the leg to a desired depth, preferably beyond the bottom of the fin plate 21 and is then fixedly clamped to the leg by drawbolts 24 having shanks extending through holes 14 of the post and aligned holes 25 through the apex of the angle iron leg 19 to be threaded into tapped holes of a nut strip or plate 26, such as shown in FIG. 5, which is tapered to seat in the apex corner of the leg 19. The heads **24*a* of the drawbolts are bottomed on the web 13 of the post 11**.

Since the drawbolts are only slightly below the surface of the ground G, the dirt can easily be removed at this level for insertion of the drawbolts. The bolts are tightened by a conventional wrench to pull the side legs 15 of the post toward the angle iron leg causing them to spread apart as illustrated in dotted lines in FIG. 5 thereby establishing a tightly clamped relationship between the post and the leg.

The drawbolts 24 and the nut strip 26 can be galvanized or otherwise treated so that they will not rust or corrode in the ground G and can be removed to disassemble the post from the anchor for repair or replacement. For example if the post has been severed at ground level after impact by a vehicle, the remaining stub of the post on the leg of the anchor is easily removed by retracting the drawbolts and a new post or the remaining section of the impacted post can be installed on the anchor.

In some instances it may be desired to bolt the post to the leg of the anchor before the anchor is driven into the ground to its fully submerged depth since the top end of the leg provides an accessible abutment surface for a driving tool even after the post is bolted on the leg.

Figure 7:
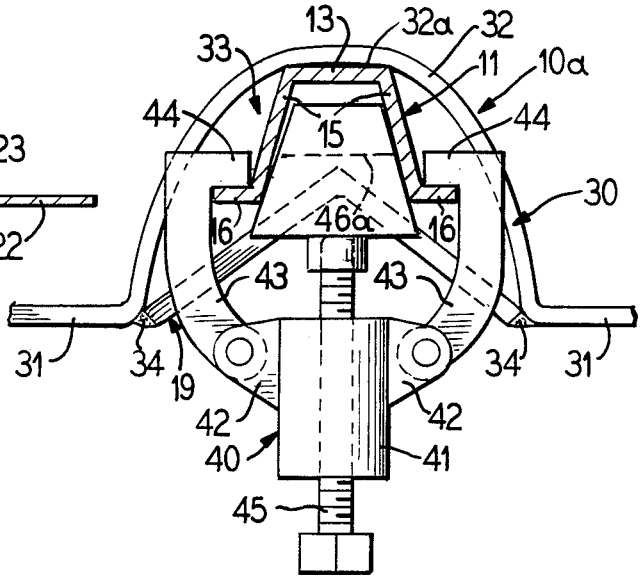
FIG. 7 is a cross-sectional view along the line VII—VII of FIG. 6.
Figure 6:
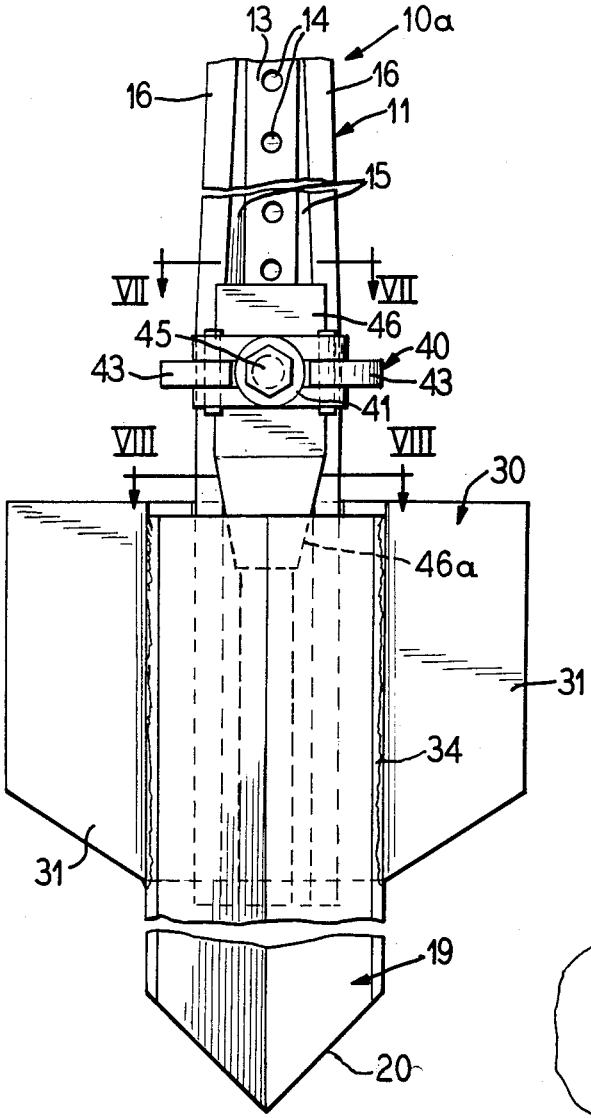
FIG. 6 is a broken front elevational view of a socket type anchor of the invention showing a spreading tool to stress the sign post for fitting into the socket of the anchor.
Figure 8:
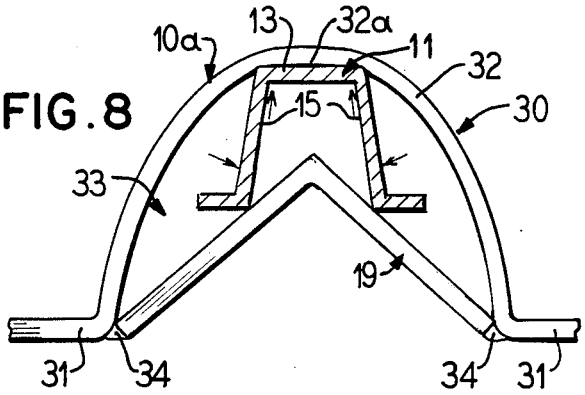
FIG. 8 is a transverse cross-sectional view along the line VIII—VIII of FIG. 6.

In the embodiment **10*a* of FIGS. 6–8, parts corresponding to the parts described in the embodiment 10 of FIGS. 1–5** have been marked with the same reference numerals.

Instead of the flat fin plate 21 of the embodiment 10, the modified embodiment **10*a* has a fin plate or strip 30 with flat laterally extending fins 31 and a central channel portion 32 embracing the angle iron leg 19 in spaced relation therefrom and providing therewith an open ended socket 33. The angle iron 19 extends into this socket. The fin strip 30 is welded at 34 to the divergent ends of the angle iron leg 19**.

The channel portion or strap portion 32 of the fin plate 30 has a base wall portion **32*a* confronting the apex of the leg 19 in spaced relation and sized for bottoming the web 13 of the post. The gap between this wall portion 32*a* and the angle iron is controlled to be less than the free state depth of the post 11 when its legs are bottomed on the angle iron so that the post can only fit into the socket 13** when it is stressed to a depth less than its free state dimension.

For the purpose of stressing the post 11 so that it can fit into the socket 33, a spreading tool 40 is applied to the post at a level spaced from the bottom end of the post a sufficient distance to permit the desired length of the post to be inserted in the socket. This tool 40 has an internally threaded hub 41 with ears 42 pivotally mounting fingers 43 which have internal lug ends 44 adapted to overlie the flanges 16 outturned from the side legs 15 of the channel post 11. A bolt 45 is threaded through the hub 41 and swivelly mounts on its inner end a conical head 46 extending into the channel of the post 11. The head 46 has a tapered bottom fringe portion **46*a* extending into the socket 33 between the apex of the angle iron 19 and the wall portion 32*a* to extend the spreading force of the head into these portions of the channel in the socket. When the bolt 45 is threaded in the hub 41 this head 46 will be forced deeper into the channel spreading the legs 15 apart and stressing the post to a lesser depth sufficient for freely seating in the socket 33. As the head 46 is driven deeper into the channel and as the legs 15 spread apart, the fingers 43 can swing outwardly about their pivots to permit free spreading of the legs. Alternately the fingers 43 and their inturned ends 44 could be extended to seat the fingers on the base web 13** of the post or a tie bar could be provided for embracing the post so that the head can be driven into the channel to expand the legs.

As indicated above, the tool 40 is positioned on the post 11 at a level spaced sufficiently from the bottom end of the post so that a stub portion of the post beyond the tool will be stressed to freely slide into the socket whereupon release of the tool, as by withdrawing the head 46 from the post channel, will permit the legs to spring toward their unstressed position thereby causing the post to ride further upwardly on the sides of the channel iron toward the apex and in so doing force the base 13 of the post against the confronting wall 32*a* of the fin strap. The post will then be held fixedly on the angle iron leg, being clamped between the leg and the strap portion of the fin plate.

As in the embodiment 10, the embodiment 10*a* maintains the post legs in a partially spread apart condition, always tending to spring back toward their free state position and in so doing, maintaining the tight clamped seating on the anchor leg.

The post is inserted into or through the socket as described in the embodiment 10 and in the event it is impacted by a vehicle or the like it will tend to fracture level with the upper end of the angle iron leg and fin plate, as explained above. This fracture zone is located at the transition area between the highly stressed post portion clamped in the socket and the unstressed portion above the socket.

Figure 9:
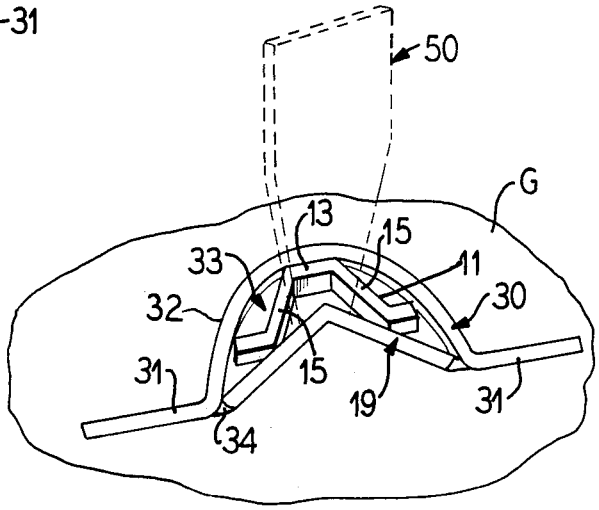
FIG. 9 is a top perspective view illustrating the manner in which a stub of a sign post can be removed from the anchor of FIGS. 6–8.

The post stub remaining underground on the leg of the anchor after fracture, does not project above ground to present an obstacle. This severed-off stub can be removed from the anchor without moving the anchor by removing the drawbolts in the embodiment 10 of FIGS. 1–5 and can be removed from the socket in the embodiment 10*a* of FIGS. 6–8, as shown in FIG. 9 where a spreading chisel 50 is driven into the top of the channel of the remaining stub portion of the post 11 thereby spreading the legs 15 permitting the post to ride further down on the angle iron 19, decreasing the effective depth of the post and permitting it to be pulled out of the socket 33.

From the above descriptions it will therefor be understood that this invention provides a ground anchor for channel type sign posts which clamps the bottom end of the post to an angle iron leg without requiring wedges which are deformed in use and which deform the post and are almost impossible to remove.

I claim:

1. A ground anchor for channel type sign posts having a web and side legs which comprises an angle iron leg adapted to be driven upright into the ground, said angle iron leg having side legs diverging from an apex and having leading and trailing ends, an upright fin plate secured to the trailing end of the angle iron leg and driven therewith into the ground to hold the angle iron leg in upright position in the ground below ground level, said angle iron leg projecting into the channel of the channel post with the side legs of the post embracing and bottomed on the sides of the angle iron leg and the web of the post spaced from the apex of the angle iron leg, adjustable means spaced apart and stressing those portions of the side legs of the channel post embracing and bottomed on the trailing end of the angle iron leg into clamped relation with the sides of the angle iron leg leaving portions of the side legs of the post above said trailing end relatively unstressed and creating a fracture zone at ground level at the transistion area between the stressed and unstressed side legs, and means holding the post on the angle iron leg in said stressed spread leg clamped position.

2. The anchor of claim 1 wherein the fin plate is planar, spans the open face of the angle iron leg, and is welded to the ends of the sides of the angle iron leg.

3. The anchor of claim 1 wherein the fin plate embraces the angle iron leg forming a socket receiving the apex of the angle iron leg and providing an abutment wall directly receiving the web of the channel post.

4. The anchor of claim 1 wherein the major length of the channel post above the angle iron leg is unstressed and a sign is bolted to the top end of the post.

5. The anchor of claim 4 wherein the side legs of the channel post have outturned fins, the sign is bottomed on the fins, and drawbolts extend through holes in the web of the channel post to clamp the sign to the fins of the post.

6. A ground anchor for channel type sign posts having a web and side legs defining a channel which comprises an angle iron leg adapted to be driven upright into the ground, said angle iron leg having leading and trailing ends and sides diverging from an apex, an upright fin plate secured to the trailing end of said angle iron leg and driven therewith into the ground to hold the angle iron leg in upright position in the ground, said angle iron leg projecting into the channel of said channel post with the side legs of the post embracing and bottomed on the sides of the angle iron leg and the web of the post spaced from the apex of the angle iron leg, and drawbolts opposite the fin plate extending through the web of the channel post and apex of the angle iron leg pulling the side legs of the post against the diverging sides of the angle iron leg spreading the post legs and clamping the post to the angle iron leg, leaving portions of the side legs of the post above said trailing end relatively unstressed and creating a fracture zone at ground level at the transition area between the stressed and unstressed side legs.

7. The anchor of claim 6 including a nut member seated in the apex of the angle iron leg receiving the drawbolts.

8. The anchor of claim 6 wherein the channel post has holes spaced along the length of the web thereof and the drawbolts are selectively seated in a plurality of said holes to control the height of the post.

9. The ground anchor of claim 6 wherein the channel post overlaps and embraces the angle iron leg to a depth at least coextensive with the bottom end of the fin plate.

10. A ground anchor for channel type sign posts having a web and side legs which comprises an angle iron leg adapted to be driven upright into the ground, said angle iron leg having leading and trailing ends and sides diverging from an apex, an upright fin plate secured to the trailing end of said angle iron leg and driven therewith into the ground to hold the angle iron leg in upright position below ground level, said angle iron leg projecting into the channel of the channel post with the side legs of the post bottomed on and embracing the sides of the angle iron leg and the web of the post spaced from the apex of the angle iron leg, said fin plate having an intermediate channel portion embracing the angle iron leg and cooperating therewith to form a socket with an abutment wall confronting the apex of the angle iron leg in spaced relation, and said channel post being locked in said socket with the web thereof directly bottomed on said abutment wall and the side legs thereof spread apart and bottomed on the sides of the angle iron leg producing a stressed area in the post below ground level merging into an unstressed area above ground level to create a fracture zone at ground level.

11. The anchor of claim 10 including a spreading tool engaging the side legs of the channel post to spread the legs apart for decreasing the depth of the channel to accommodate seating of the bottom end of the post into the socket.

12. The ground anchor of claim 10 wherein the gap between the abutment wall and the side legs of the angle iron leg bottoming the side legs of the sign post is less than the free state depth of the sign post channel to maintain the channel post clamped against the angle iron leg.

* * * * *